US006090241A

United States Patent [19]

Trokhan et al.

[11] Patent Number: 6,090,241

[45] **Date of Patent: *Jul. 18, 2000**

[54] ULTRASONICALLY-ASSISTED PROCESS FOR MAKING DIFFERENTIAL DENSITY CELLULOSIC STRUCTURE CONTAINING FLUID-LATENT INDIGENOUS POLYMERS

[75] Inventors: Paul Dennis Trokhan, Hamilton; Nagabhusan Senapati, Worthington, both of Ohio

[73] Assignee: The Procter & Gamble Company, Cincinnati, Ohio

[ * ] Notice: This patent is subject to a terminal disclaimer.

[21] Appl. No.: 09/065,655

[22] Filed: Apr. 23, 1998

Related U.S. Application Data

[63] Continuation-in-part of application No. 08/870,535, Jun. 6, 1997, Pat. No. 5,935,381.

[51] Int. Cl.[7] ..... D21H 11/00

[52] U.S. Cl. ..... 162/109; 162/192; 162/205; 162/207; 162/117; 162/111

[58] Field of Search ..... 162/109, 111, 162/113, 203, 204, 205, 206, 207, 117, 198, 192; 34/414, 419, 421, 422

[56] References Cited

U.S. PATENT DOCUMENTS

| | | | |
|---|---|---|---|
| 3,970,552 | 7/1976 | Bongert . | |
| 4,729,175 | 3/1988 | Beard et al. . | |
| 5,292,421 | 3/1994 | Senapati et al. . | |
| 5,711,847 | 1/1998 | Rajala et al. . | |
| 5,935,381 | 8/1999 | Trokhan et al. | 162/109 |
| 5,938,893 | 8/1999 | Trokhan | 162/109 |

FOREIGN PATENT DOCUMENTS

| | | |
|---|---|---|
| 0 745 717 | 12/1996 | European Pat. Off. . |
| WO 98/21409 | 5/1998 | WIPO . |
| WO 98/27277 | 6/1998 | WIPO . |
| WO 98/55689 | 12/1998 | WIPO . |

OTHER PUBLICATIONS

H.S. Muralidhara, "Acoustic Dewatering and Drying (Low and High Frequency): State of the Art Review"; *Drying Technology*, 3(4), 529–566 (1985).

N. Senapati, "Applied Ultrasonics"; Aug. 1996; various pages.

N. Senapati, "Dewatering by Electro–Acoustic Techniques"; *Flocculation & Dewatering*, p. 421–431 (1989).

W.F. Metcalf, "The Effects of improved ultrasonic technology on continuous bonding of nonwoven fabrics"; *Tappi Journal*, vol. 77, No. 6, p. 211–215.

N. Senapati, "Ultrasound in Chemical Processing"; *Advances in Sonochemistry*, vol. 2, pp. 187–210 (1991).

V.M. Bobtenkov et al., "New Method of Pressing Cardboard", 1977, June.

*Primary Examiner*—Stanley S. Silverman
*Assistant Examiner*—José A. Fortuna
*Attorney, Agent, or Firm*—Vladmir Vitenberg; Larry L. Huston; Donald E. Hasse

[57] ABSTRACT

A process and an apparatus for making a differential density cellulosic web comprising a first plurality of high-density micro-regions and a second plurality of low-density micro-regions are disclosed. The process comprises the steps of providing a fibrous web containing fluid-latent indigenous polymers and water; depositing the web on a fluid-permeable molding fabric; applying ultrasonic energy to the web, thereby contributing to softening of the fluid-latent indigenous polymers in at least selected portions of the web; impressing the molding fabric into the web, thereby densifying the selected portions of the web and causing the fluid-latent indigenous polymers to flow and interconnect the fibers which are mutually juxtaposed in the selected portions; and immobilizing the fluid-latent indigenous polymers, thereby creating bonds thereof between the fibers which are interconnected in the selected portions. An apparatus comprises an ultrasonic means for applying ultrasonic energy to the web associated with the molding fabric, and a pressing means for impressing the molding fabric into the web.

27 Claims, 7 Drawing Sheets

ULTRASONICALLY-ASSISTED PROCESS FOR MAKING DIFFERENTIAL DENSITY CELLULOSIC STRUCTURE CONTAINING FLUID-LATENT INDIGENOUS POLYMERS

This application is a Continuation-In-Part of commonly assigned Ser. No. 08/870,535, filed on Jun. 6, 1997, now U.S. Pat. No. 5,935,381.

FIELD OF THE INVENTION

The present invention is related to processes for making strong, soft, absorbent cellulosic webs. More particularly, this invention is concerned with cellulosic webs having high density micro-regions and low density micro-regions, and the processes and apparatuses for making such cellulosic webs.

BACKGROUND OF THE INVENTION

Paper products are used for a variety of purposes. Paper towels, facial tissues, toilet tissues, and the like are in constant use in modern industrialized societies. The large demand for such paper products has created a demand for improved versions of the products. If the paper products such as paper towels, facial tissues, toilet tissues, and the like are to perform their intended tasks and to find wide acceptance, they must possess certain physical characteristics. Among the more important of these characteristics are absorbency, softness, and strength.

Absorbency is the characteristic of the paper that allows the paper to take up and retain fluids, particularly water and aqueous solutions and suspensions. Important not only is the absolute quantity of fluid a given amount of paper will hold, but also the rate at which the paper will absorb the fluid. Softness is the pleasing tactile sensation consumers perceive when they use the paper for its intended purposes. Strength is the ability of a paper web to retain its physical integrity during use.

There is a well-established relationship between strength and density of the web. Therefore efforts have been made to produce highly densified paper webs. One of such methods is disclosed in the U.S. Pat. No. 4,112,586 issued Sep. 12, 1978; the U.S. Pat. Nos. 4,506,456 and 4,506,457 both issued Mar. 26, 1985; U.S. Pat. No. 4,899,461 issued Feb. 13, 1990; U.S. Pat. No. 4,932,139 issued Jun. 12, 1990; U.S. Pat. No. 5,594,997 issued Jan. 21, 1997, all foregoing patents issued to Lehtinen; and U.S. Pat. No. 4,622,758 issued Nov. 18, 1986 to Lehtinen et al.; U.S. Pat. No. 4,958,444 issued Sep. 25, 1990 to Rautakorpi et al. All the foregoing patents are assigned to Valmet Corporation of Finland and incorporated by reference herein.

This technology uses a pair of moving endless bands to dry the web which is pressed and moves between and in parallel with the bands. The bands have different temperatures. A thermal gradient drives water from the relatively hot side, and the water condenses into a fabric on the relatively cold side. While the web is wet and under pressure and elevated temperature, a combination of temperature, pressure, moisture content of the web, and residence time causes the hemicelluloses and lignin contained in the papermaking fibers of the web to soften and flow, thereby interconnecting and "welding" the papermaking fibers together.

While the described technology allows production of a highly-densified strong paper suitable for packaging needs, this method is not adequate to produce a strong and—at the same time—soft paper suitable for such consumer-disposable products as facial tissue, paper towel, napkins, toilet tissue, and the like. It is well known in the art that increasing the density of a paper generally decreases the paper's absorbency and softness characteristics, which are important for the consumer-disposable product mentioned above.

Cellulosic structures currently made by the present assignee contain multiple micro-regions defined most typically by differences in density. The differential density cellulosic structures are created by—first, an application of vacuum pressure to the wet web associated with a molding belt, thereby deflecting a portion of the papermaking fibers to generate low-density micro-regions, and—second, pressing portions of the web comprising non-deflected papermaking fibers against a hard surface, such as a surface of a Yankee dryer drum, to form high-density micro-regions. The high-density micro-regions of the resulting cellulosic structure generate strength, while the low-density micro-regions contribute softness, bulk and absorbency.

Such differential density cellulosic structures may be produced using through-air drying papermaking belts comprising a reinforcing structure and a resinous framework, which belts are described in commonly assigned U.S. Pat. No. 4,514,345 issued to Johnson et al. on Apr. 30, 1985; U.S. Pat. No. 4,528,239 issued to Trokhan on Jul. 9, 1985; U.S. Pat. No. 4,529,480 issued to Trokhan on Jul. 16, 1985; U.S. Pat. No. 4,637,859 issued to Trokhan on Jan. 20, 1987; U.S. Pat. No. 5,334,289 issued to Trokhan et al on Aug. 2, 1994. The foregoing patents are incorporated herein by reference.

As well known in the papermaking art, wood typically used in papermaking inherently comprises cellulose (about 45%), hemicelluloses (about 25–35%), lignin (about 21–25%) and extractives (about 2–8%). G. A. Smook, *Handbook for Pulp & Paper Technologists, TAPPI,* 4th printing, 1987, pages 6–7, which book is incorporated by reference herein. Hemicelluloses are polymers of hexoses (glucose, mannose, and galactose) and pentoses (xylose and arabinose). Id., at 5. Lignin is an amorphous, highly polymerized substance which comprises an outer layer of a fiber. Id., at 6. Extractives are a variety of diverse substances present in native fibers, such as resin acids, fatty acids, turpenoid compounds, and alcohols. Id. As used herein, hemicelluloses, lignin, and polymeric extractives inherently present in cellulosic fibers are defined by a generic term "fluid-latent indigenous polymers" or "FLIP." Hemicelluloses, lignin, and polymeric extractives are typically a part of cellulosic fibers, but may be added independently to a plurality of papermaking cellulosic fibers, or web, as part of a papermaking process.

Traditional papermaking conditions, such as the temperature of the web and duration of the application of pressure during transfer of the moist web to the Yankee dryer, are not adequate to cause FLIP to soften and flow in the high-density micro-regions.

The commonly assigned co-pending patent applications entitled "Differential Density Cellulosic Structure and Process for Making Same" filed on Jun. 6, 1997 and "Fibrous Structure and Process for Making Same" filed on Aug. 15, 1997, both of which are incorporated by reference herein, disclose the process for making cellulosic and fibrous structures comprising micro-regions formed by a process of softening the fluid-latent indigenous polymers inherently contained in and/or added to the cellulosic papermaking fibers, then allowing the fluid-latent indigenous polymers to flow thereby interconnecting the adjacent papermaking fibers of the high-density micro-regions, and finally immobilizing the fluid-latent indigenous polymers in the high-density micro-regions. In order to achieve sufficient fluidization of the fluid-latent indigenous polymers contained in the web, the web must be subjected to an intensive heating for a certain period of time (a residence time). Reduction of the residence time can provide significant increase in the speed of the papermaking process and, consequently, a sufficient economic benefit.

U.S. Pat. No. 4,729,175, issued to Beard et al. on Mar. 8, 1988, discloses a method and apparatus for applying ultrasonic energy to a continuously moving web of paperboard, while simultaneously press-drying and heating the web. Now, it is believed that a suitable field of ultrasonic energy can be coupled to the web in order to initiate fluidization of the fluid-latent indigenous polymers contained in the web. Additionally or alternatively, the application of the ultrasonic energy enhances the fluidization of the fluid-latent indigenous polymers, if the ultrasonic energy is applied to the web while the web is heated. It is believed that the ultrasonic vibrations coupled to the web assist in fluidization of the fluid-latent indigenous polymers due to internal absorption of the ultrasonic energy by the fluid-latent indigenous polymers and their shear thinning, i.e., decrease of the viscosity of the fluid-latent indigenous polymers. The use of ultrasonic energy can, therefore, help to reduce the residence time necessary to achieve the fluidization of the fluid-latent indigenous polymers and thus create conditions for speeding up the entire papermaking process.

Accordingly, it is the purpose of the present invention to provide an improved papermaking process comprising a step of ultrasonically assisted softening of the fluid-latent indigenous polymers contained in the web.

It is another object of the present invention to provide an improved papermaking process in which the heating energy produced by a conventional heating means and the ultrasonic energy produced by an ultrasonic means are coupled together to work in concert to accelerate fluidization of the fluid-latent indigenous polymers contained in the web.

It is another object of the present invention to provide an improved papermaking process for making a cellulosic structure having a plurality of high-density micro-regions and a plurality of low-density micro-regions, the plurality of high-density micro-regions comprising bonds of the fluid-latent indigenous polymers contained in the cellulosic web.

It is still another object of the present invention to provide an apparatus for the process of making a cellulosic structure having a plurality of high-density micro-regions comprising bonds of the fluid-latent indigenous polymers, the apparatus having an ultrasonic means for contributing to the formation of the bonds.

SUMMARY OF THE INVENTION

The process of the present invention comprises the following steps: providing a fibrous web comprising fluid-latent indigenous polymers and water; providing a macroscopically monoplanar and fluid-permeable molding fabric having a web-side surface and a backside surface opposite to the web-side surface; depositing the fibrous web on the web-side surface of the molding fabric; applying ultrasonic vibrations to at least selected portions of the fibrous web, thereby contributing to softening of the fluid-latent indigenous polymers in the selected portions; impressing the web-side surface of the molding fabric into the fibrous web under pressure, thereby densifying the selected portions of the web and causing the fluid-latent indigenous polymers to flow and interconnect the cellulosic fibers which are mutually juxtaposed in the selected portions; and immobilizing the flowing fluid-latent indigenous polymers and creating bonds of the fluid-latent indigenous polymers between the cellulosic fibers which are interconnected in at least the selected portions of the fibrous web, thereby forming a first plurality of high-density micro-regions from the selected portions.

Preferably, the process further comprises the step of heating at least the selected portions of the web. More preferably, the steps of heating and applying ultrasonic energy are coupled to work in cooperation in order to cause softening of the fluid-latent indigenous polymers in the selected portions of the web. The step of applying the ultrasonic energy may precede, follow, and/or be performed concurrently with the step of heating the web. Preferably, the step of heating the selected portions and the step of impressing are performed concurrently. A step of heating the web can be accomplished by a variety of means known in the art. For example, the web may be heated by a hot heating band in contact with the web, the heating band being heated by a heating apparatus.

The preferred range of frequency of the ultrasonic energy is between about 16,000 Hz and about 100,000 Hz. The more preferred frequency range is between about 20,000 Hz and about 80,000 Hz. The preferred amount of the ultrasonic energy is from about 1 Watt per square centimeter ($W/cm^2$) to about 100 $W/cm^2$. The more preferred amount of the ultrasonic energy is from about 5 $W/cm^2$ to about 50 $W/cm^2$. The preferred range of vibration amplitude is from 5 micrometers to 200 micro-meters peak to peak. The more preferred range of vibration amplitude is from 20 micro-meters to 100 micro-meters peak to peak. In a preferred continuous process, a velocity of the web through the equipment may be selected based upon a desired residence (or exposure) time, which should be sufficient for the ultrasonic to diffuse the fluid latent indigenous polymers contained in the web into and between the web's fibers of the selected portions of the web. The preferred residence time is from about 1 millisecond to about 100 milliseconds, and more preferred residence time is from 1 millisecond to 10 milliseconds.

The step of immobilizing the flowing fluid-latent indigenous polymers and creating bonds thereof may be accomplished by either one or a combination of the following: drying at least a first portion of the web, cooling at least the first portion of the web, and/or releasing the pressure caused by the step of impressing the web-side surface of the forming belt into the web.

In a continuous process of the present invention, the molding fabric comprises an endless papermaking belt, preferably having deflection conduits extending in the Z-direction between the belt's mutually opposite surfaces. More preferably, the belt comprises a resinous framework joined to a reinforcing structure.

The process may further comprise the step of applying a fluid pressure differential to the web such as to leave the first portion of the cellulosic fibers on the web-side surface of the belt, while deflecting the second portion of the cellulosic fibers into the deflection conduits and removing a portion of the liquid carrier from the web.

An apparatus of the present invention comprises an ultrasonic means for applying ultrasonic energy to the web, and a pressing means for pressurizing the web. Preferably, the apparatus of the present invention further comprises a heating means for heating at least selected portions of the web. More preferably, the apparatus is designed such that the ultrasonic means and the heating means provide a combined energy in the amount sufficient to cause softening of the fluid-latent indigenous polymers in at least the selected portions of the web. The pressing means, by pressing the web against the molding fabric, causes densification of the selected portions of the web, and further causes the softened fluid-latent indigenous polymers to flow in the selected portions, thereby interconnecting mutually juxtaposed cellulosic fibers in the selected portions.

The preferred ultrasonic means comprise an ultrasonic applicator juxtaposed with an anvil supporting the molding belt having the web thereon. The ultrasonic applicator and the anvil form an ultrasonic nip therebetween. In the preferred continuous process, the web disposed on the molding belt passes through the ultrasonic nip and is thereby subjected to an effect of the ultrasonic energy. The ultrasonic applicator generates vibrations at ultrasonic frequencies and couples the vibrations to the web. The ultrasonic vibrations coupled to the web help to diffuse the fluid latent indigenous polymers contained in the web into and between the fibers of the web, thereby contributing to the process of fluidization of the fluid latent indigenous polymers.

The pressing means apply pressure to the web, also contributing to the process of fluidization of the fluid latent indigenous polymers. By densifying the selected portions of the web, the pressing means also help to create bonds of the fluid-latent indigenous polymers between the interconnected fibers. Generally, the pressing means comprises a pair of mutually opposite press surfaces, a web-contacting press surface and a belt-contacting press surface, designed to receive the web with the associated fabric therebetween. The web-contacting press surface may have a pattern thereon. Preferably, the pattern comprises a macroscopically-planar and continuously-reticulated network. In one embodiment, the web-contacting press surface comprises at least one patterned roll which is juxtaposed with a belt-contacting press surface comprising a support roll, the pattern roll and the support roll having a nip therebetween, through which the web and the belt travel in the machine direction. In another embodiment, the web-contacting press surface comprises a Yankee drum's outer surface, and the web-contacting press surface comprises at least one impression roll. In one preferred embodiment, the relatively high mechanical pressure, in the order of from about 100 pounds per square inch (psi) to about 10000 psi, and preferably from about 500 psi to about 5000 psi, is instantaneously applied to the selected portions of the web immediately following the step of ultrasonic application.

In the preferred embodiment, the temperature, the ultrasonic energy, and the pressure work in concert to fluidize the fluid-latent indigenous polymers. An embodiment is possible, and may even be preferred, in which the ultrasonic energy is applied to the web simultaneously with the application of heating and pressure.

DETAILED DESCRIPTION OF THE INVENTION

The papermaking process of the present invention comprises a number of steps or operations which occur in the general time sequence as noted below. It is to be understood, however, that the steps described below are intended to assist a reader in understanding the process of the present invention, and that the invention is not limited to processes with only a certain number or arrangement of steps. In this regard, it is noted that it is possible, and in some cases even preferable, to combine at least some of the following steps so that they are performed concurrently. Likewise, it is possible to separate at least some of the following steps into two or more steps without departing from the scope of this invention.

The first step of the process of the present invention is providing a fibrous web 10 comprising a fluid-latent indigenous polymers and water. As used herein, the term "fibrous web" includes any web comprising cellulosic fibers, synthetic fibers, or any combination thereof. The preferred consistency of the web 10 is from about 10% to about 70% (i.e., about 90%–30% of water), and the more preferred consistency is from about 15% to about 30% (i. e., about 85%–70% of water). The preferred basis weight of the web is from about 10 gram per square meter to about 65 gram per square meter. However, webs having other basis weights may also be used in the process of the present invention.

The fibrous web 10 may be made by any papermaking process known in the art, including, but not limited to, a conventional process and a through-air drying process. The use of a dry web that has been re-moistened is also contemplated in the present invention. The preferred consistency of the re-moistened web is from about 35% to about 65%. Suitable fibers 100 (FIGS. 1, 1A, and 1C) forming the web 10 may include recycled, or secondary, papermaking fibers, as well as virgin papermaking fibers. The fibers 100 may comprise hardwood fibers, softwood fibers, and non-wood fibers.

Figure 1:
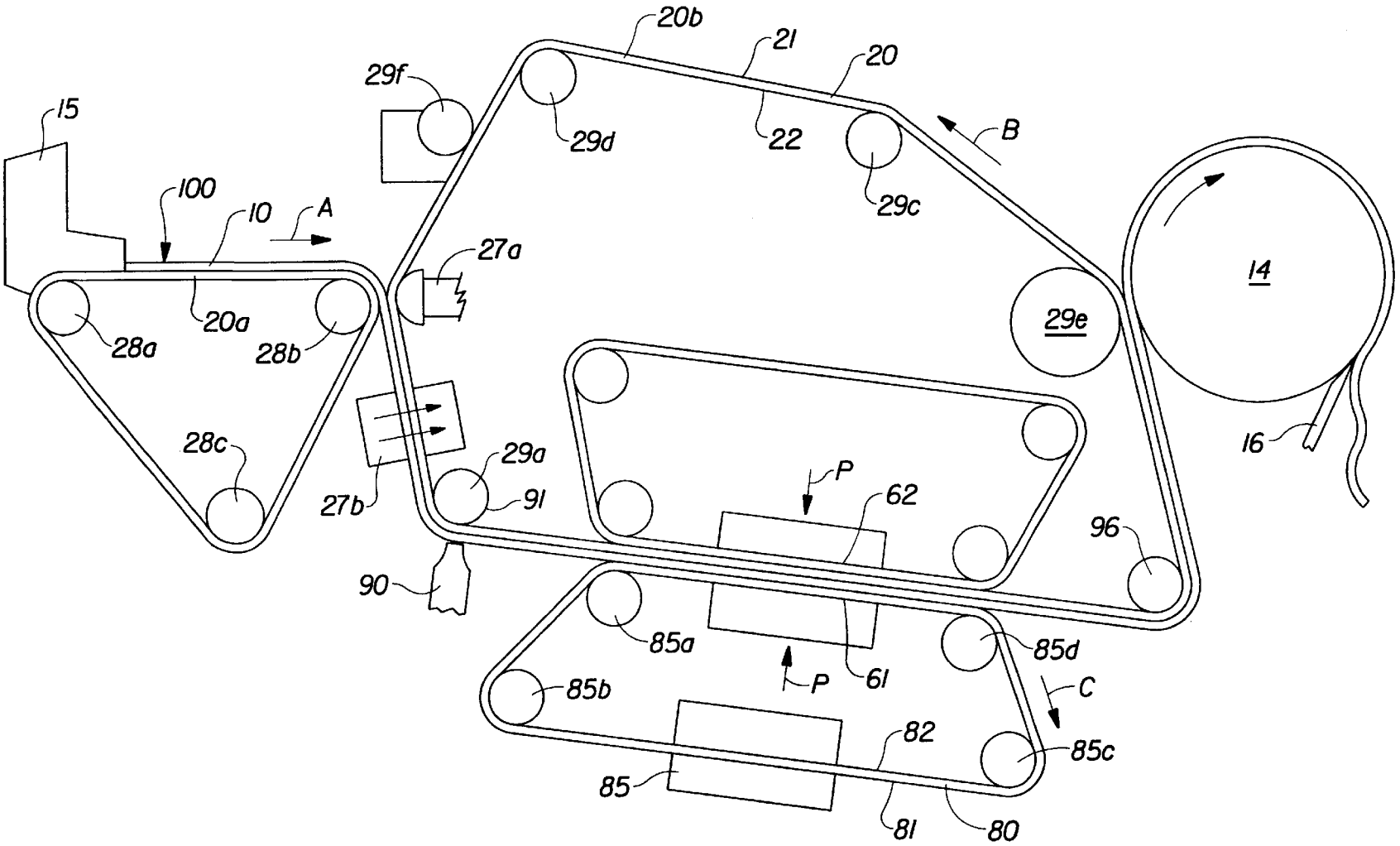
FIG. 1 is a schematic side elevational view of one exemplary embodiment of a continuous papermaking process of the present invention, showing a web being subjected to an ultrasonic energy, heated by a hot band and impressed, with the belt, between a pair of press surfaces.
Figure 1A:
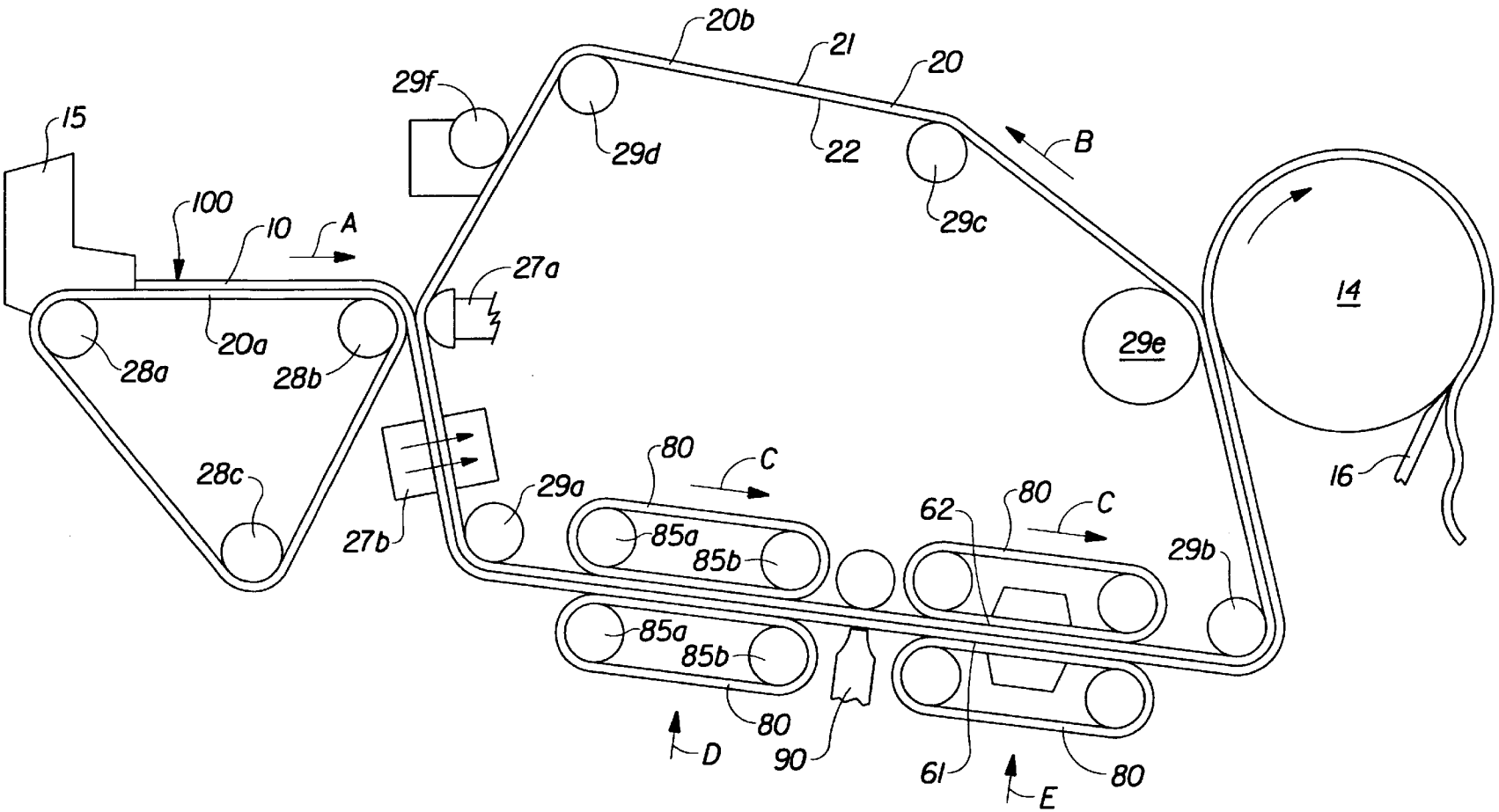
FIG. 1A is a schematic side elevational view of another exemplary embodiment of a continuous papermaking process of the present invention, showing a web being first heated by a heating wire, then subjected to an ultrasonic energy, and finally heated by another heating wire and simultaneously impressed, with the belt, between a pair of press surfaces.
Figure 1B:
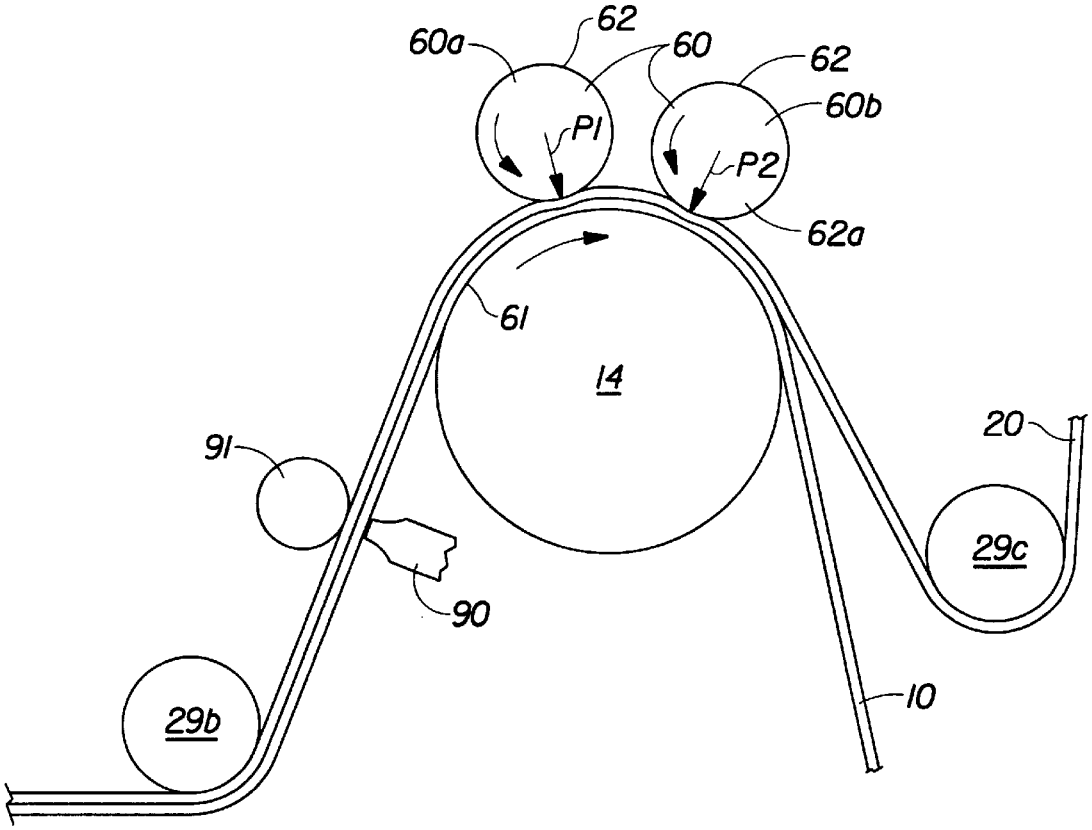
FIG. 1B is a schematic fragmental side elevational view of the process of the present invention, showing a web being first subjected to an ultrasonic energy and then impressed, with the belt, between a drying drum and impressing rolls.
Figure 1C:
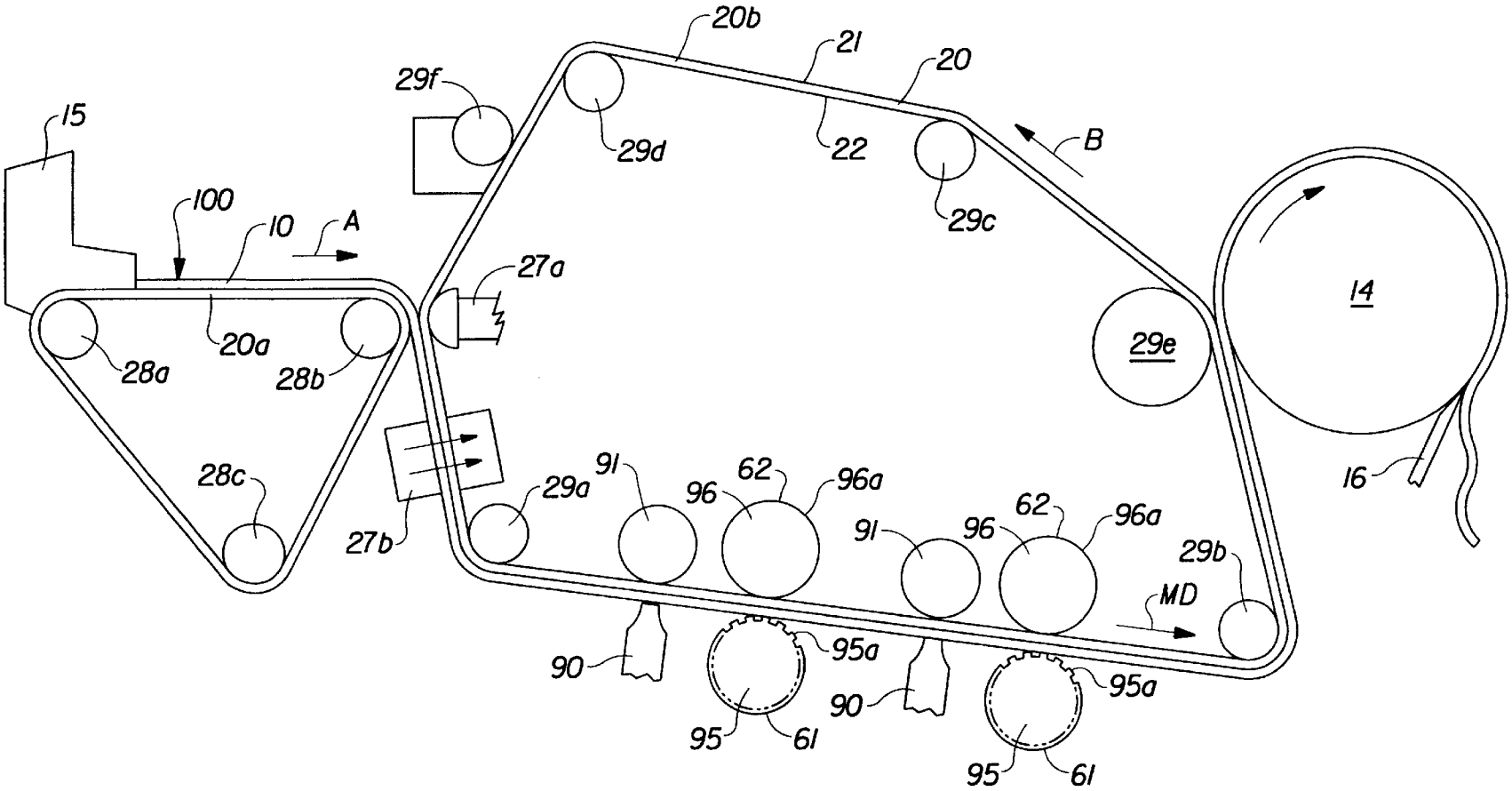
FIG. 1C a schematic side elevational view of an exemplary embodiment of a continuous papermaking process of the present invention, showing a web being twice subjected to the ultrasonic energy, and then impressed between a pair of rolls.

Of course, the step of providing a fibrous web 10 may be preceded by the steps of forming such a fibrous web 10, as schematically shown in FIGS. 1, 1A, and 1C. One skilled in the art will readily recognize that the step of forming the fibrous web 10 may include the step of providing a plurality of fibers 100. In a typical process, the plurality of the fibers 100 are preferably suspended in a fluid carrier. More preferably, the plurality of the fibers 100 comprises an aqueous dispersion of the fibers 100. The equipment for preparing the aqueous dispersion of the fibers 100 is well-known in the art and is therefore not shown in FIGS. 1, 1A, and 1C. The aqueous dispersion of the fibers 100 may be provided to a headbox 15. A single headbox 15 is shown in FIGS. 1, 1A, and 1C; however, it is to be understood that there may be multiple headboxes in alternative arrangements of the process of the present invention. The headbox(es) and the equipment for preparing the aqueous dispersion of fibers are typically of the type disclosed in U.S. Pat. No. 3,994,771, issued to Morgan and Rich on Nov. 30, 1976, which patent is incorporated by reference herein. The preparation of the aqueous dispersion of the papermaking fibers and the characteristics of such an aqueous dispersion are described in greater detail in U.S. Pat. No. 4,529,480 issued to Trokhan on Jul. 16, 1985, which patent is incorporated herein by reference. The fibrous web 10 can be made by any of several forming processes including the processes using a Fourdrinier, twin wire, crescent former, or cylinder former.

According to the present invention, the fibrous web 10 comprises fluid-latent indigenous polymers. The preferred fluid-latent indigenous polymers of the present invention are selected from the group consisting of lignin, hemicelluloses, extractives, and any combination thereof. Other types of the fluid-latent indigenous polymers may also be utilized if desired. European Patent Application EP 0 616 074 A1 discloses a paper sheet formed by a wet-pressing process and adding a wet-strength resin to the papermaking fibers.

As well known in the papermaking art, and as noted in the Background, typically, wood used in papermaking inherently comprises cellulose, hemicelluloses, lignin, and extractives. As a result of mechanical or chemical treatment of wood to produce pulp, portions of hemicelluloses, lignin, and extractives are removed from the papermaking fibers. The removal of most of the lignin while retaining substantial amounts of hemicelluloses is generally viewed as a desirable occurrence, because the removal of lignin increases ability of fibers 100 to form inter-fiber hydrogen bonds, and also increases absorbency of the resulting web. Although some portion of the fluid-latent indigenous polymers inherently contained in the pulp is removed from the papermaking fibers during mechanical or chemical treatment of the wood, the papermaking fibers still retain a portion of the fluid-latent indigenous polymers even after the chemical treatment.

Alternatively or additionally, the fluid-latent indigenous polymers may be supplied independently from the fibers 100 and added to the web 10, or to the fibers 100 before the web 10 has been formed. Independent deposition of the fluid-latent indigenous polymers in the web 10 or in the fibers 100 may be preferred, and even necessary, if the fibers 100 do not inherently contain a sufficient amount of the fluid-latent indigenous polymers, or do not inherently contain the fluid-latent indigenous polymers at all (as, for example, synthetic fibers). The fluid-latent indigenous polymers may be deposited in/on the web 10 or the fibers 100 in the form of substantially pure chemical compounds. Alternatively, the fluid-latent indigenous polymers may be deposited in the form of cellulosic fibers containing the fluid-latent indigenous polymers.

The next step is providing a macroscopically monoplanar molding fabric, or belt, 20. As used herein, the term "molding fabric" is a generic term which, in the context of the continuous process schematically shown in FIGS. 1, 1A, and 1C, may include both a forming belt 20*a* and a papermaking belt 20*b*, both belts shown in the preferred form of an endless belt. Typically, the papermaking belt is the "molding" belt 20. In FIGS. 1A, 1B, and 1C, the forming belt 20*a* passes around return rolls 28*a*, 28*b*, and 28*c* in the direction of the directional arrow A; and the papermaking (molding) belt 20*b* passes around return rolls 29*a*, 29*b*, 29*c*, and 29*d* in the direction of the directional arrow B.

While the use of the separate belts 20*a* and 20*b*, as shown in FIGS. 1A, 1B, and 1C, is preferred, the present invention may utilize the single belt 20 functioning as both the forming belt 20*a* and the papermaking belt 20*b*; this embodiment is not shown in the figures of the present invention but may easily be visualized by one skilled in the art. One skilled in the art will also understand that the present invention may utilize more than two belts; for example, a drying belt (not shown), separate from both the forming belt 20*a* and the papermaking belt 20*b*, may be used. For simplicity, the generic term "belt 20" will be used hereinafter where appropriate.

As schematically shown in FIGS. 1–4, the belt 20 has a web-side surface 21 defining an X-Y plane, a backside surface 22 opposite to the web-side surface 21, and a Z-direction perpendicular to the X-Y plane. The belt 20 may be made according to the following commonly assigned and incorporated herein by reference U.S. Pat. No. 4,514,345 issued to Johnson et al. on Apr. 30, 1985; U.S. Pat. No. 4,528,239 issued to Trokhan on Jul. 9, 1985; U.S. Pat. No. 4,529,480 issued to Trokhan on Jul. 16, 1985; U.S. Pat. No. 4,637,859 issued to Trokhan on Jan. 20, 1987; U.S. Pat. No. 5,334,289 issued to Trokhan et al. on Aug. 2, 1994; U.S. Pat. No. 5,628,876 issued to Ayers et al. on May, 13, 1997.

Also, the commonly assigned U.S. Pat. No. 4,239,065, issued Dec. 16, 1980, in the name of Trokhan and incorporated by reference herein, discloses the type of the belt 20 that can be utilized in the present invention. The belt disclosed in U.S. Pat. No. 4,239,065 has no resinous framework, and the web-side surface of the foregoing belt is defined by co-planar crossovers of mutually interwoven filaments distributed in a predetermined pattern throughout the belt.

Another type of the belt which can be utilized as the belt 20 in the process of the present invention is disclosed in the European Patent Application having Publication Number: 0 677 612 A2, filed Dec. 4, 1995.

In the present invention, the belt 20, having a woven element as the reinforcing structure 50, as shown in FIGS. 2, 2A, 3, and 3A, is preferred. However, the belt 20 can be made using a felt as a reinforcing structure, as set forth in U.S. Pat. No. 5,556,509 issued Sep. 17, 1996 to Trokhan et al. and the patent application Ser. No. 08/391,372 filed Feb. 15, 1995 in the name of Trokhan et al. and entitled: "Method of Applying a Curable Resin to a Substrate for Use in Papermaking"; Ser. No. 08/461,832 filed Jun. 5, 1995 in the name of Trokhan et al. and entitled: "Web Patterning Apparatus Comprising a Felt Layer and a Photosensitive Resin Layer." These patent and patent applications are assigned to The Procter & Gamble Company and are incorporated herein by reference.

In the embodiments illustrated in FIGS. 1, 1A, 1B, and 1C, the belt 20 travels in the direction indicated by the directional arrow B. In FIGS. 1, 1A, and 1C, the belt 20 passes around return rolls 29*a*, 29*b*, an impression nip roll 29*e*, and return rolls 29*c*, and 29*d*. An emulsion-distributing roll 29*f* distributes an emulsion onto the belt 20 from an emulsion bath. If desired, the loop around which the belt 20 travels may also include means for applying fluid pressure differential to the web 10, such, for example, as a vacuum pick-up shoe 27*a*, or a vacuum box 27*b*, or both. The loop may also include a pre-dryer (not shown). In addition, water showers (not shown) are preferably utilized in the papermaking process of the present invention to clean the belt 20 of any paper fibers, adhesives, and the like, which may remain attached to the belt 20 after it has traveled through the final step of the process. Associated with the belt 20, and also not shown in FIGS. 1, 1A, and 1C, are various additional support rolls, return rolls, cleaning means, drive means, and the like, commonly used in papermaking machines and well-known to those skilled in the art.

The next step is depositing the fibrous web 10 on the web-side surface 21 of the belt 20. If the web 10 is transferred from the belt 20*a* to the belt 20*b*, conventional equipment, such as vacuum pick-up shoe 27*a* (FIGS. 1, 1A, and 1C), may be utilized to accomplish the transferal. As has been pointed out above, the single belt may be utilized as both the forming belt 20*a* and the papermaking belt 20*b*, in which instance the step of transferal is not applicable, as one skilled in the art will readily appreciate. One skilled in the art will also understand that the vacuum pick-up shoe 27*a* shown in FIGS. 1 and 1A is the one preferred means of transferring the web 10 from the forming belt 20*a* to the molding belt 20*b*. Other equipment, such as intermediate belt or the like (not shown) may be utilized for the purpose of transferring the web 10 from the forming belt 20*a* to the molding belt 20*b*. The commonly assigned U.S. Pat. No. 4,440,579 issued Apr. 3, 1984 to Wells et al. is incorporated by reference herein.

The next step in the process of the present invention comprises applying ultrasonic energy to the web 10. As used herein, the term "ultrasonic energy" means the energy comprising pressure waves or elastic waves having frequency higher than about 16,000 Hz (cycles per second). In the present invention, the preferred range of the ultrasonic frequency is from about 16,000 Hz to about 100,000 Hz. The more preferred range is from about 20,000 Hz to about 80,000 Hz. It is believed that the application of the ultrasonic energy can sufficiently fluidize the fluid-latent indigenous polymers, or at least to create conditions for their easier fluidization by subsequent heating (convective, conductive, or radiative heating), such as to cause the fluid-latent indigenous polymers to flow under the pressure and interconnect the mutually juxtaposed fibers in the web 10. Without wishing to be limited by theory, the applicants believe that the ultrasonic vibrations coupled to the web helps to decrease viscosity of the fluid-latent indigenous polymers due to shear thinning. The heating of the web 10 may be conducted prior to, simultaneously with, or subsequently to the application of the ultrasonic energy. Coupling the ultrasonic energy to geometrically-selective micro-regions of the web 10 allows to produce a paper having a specific predetermined pattern of high-density micro-regions formed by bonds of the immobilized fluid-latent indigenous polymers. As used herein, the terms "fluidize" and "fluidization" are used to describe progressive softening of the fluid-latent indigenous polymers.

The ultrasonic energy is said to be "coupled to the web 10" when a source of the ultrasonic energy, or an ultrasonic applicator 90, contacts the web 10 by vibrating at ultrasonic frequencies. Preferably, the ultrasonic applicator 90 is juxtaposed with an anvil 91 to form an ultrasonic nip therebetween. In the preferred continuous process of the present invention, the web 10 and the molding belt 20 travel through the ultrasonic nip in the machine direction. The anvil 91 provides support for the web 10 and the belt 20 associated therewith when the ultrasonic applicator 90 contacts the web 10. In FIG. 1, the ultrasonic nip is formed between the ultrasonic applicator 90 and the roll 29*a*, which comprises an anvil 91. While the rotating anvil 91 is preferred, a stationary anvil may also be used in some embodiments (not shown) of the present invention. In FIG. 1A, the ultrasonic nip is formed intermediate two heating zones D and E (described below). In FIG. 1B, the web 10 is subjected to the application of the ultrasonic energy prior to being associated with a Yankee dryer drum 14.

There are a variety of ultrasonic devices which can be used as the ultrasonic applicator 90 in the present invention. Examples include but are not limited to the such devices as a rectangular bar horn or resonant wave guides having a variety of cross-sections perpendicular to an active surface, i.e., the surface which is designed to be in contact with the web during the step of application of the ultrasonic energy to the web. These cross-section include, but are not limited to, exponential, catanoidal, conical, or stepped profiles, to provide different levels of mechanical amplification. The applicators 90 may be driven by various sources of power, such as, for example, piezoelectric, or magnetostrictive converter powered by electronic oscillator.

Generally, all these devises have a mechanically-resonating horn or a wave guide producing mechanical vibration at the active surface in contact with the web 10. The frequency of the mechanical vibration comprises the resonant frequency of the selected ultrasonic applicator. Preferably, the vibration amplitude ranges from 5 micrometers to 200 micro-meters peak to peak, and more preferably, from 20 micro-meters to 100 micro-meters peak to peak.

The ultrasonic vibration coupled to the web 10 helps to diffuse the fluid latent indigenous polymers contained in the web 10 into and/or between the fibers 100. The ultrasonic vibrations are coupled to the web 10 under pressure, preferably in the range from about 50 pounds per square inch (psi) to about 100 psi. The preferred level of the ultrasonic energy is from about 1 Watt per square centimeter ($W/cm^2$) to about 100 $W/cm^2$, and the more preferred level of the ultrasonic energy is from about 5 $W/cm^2$ to about 50 $W/cm^2$. An exposure, or residence, time, i.e., the time during which a particular portion of the web 10 is subjected to the application of the ultrasonic energy, is preferably from about 1 millisecond to about 100 milliseconds, and more preferably from about 1 millisecond to about 10 milliseconds.

The ultrasonic energy may be applied to the web 10 in series. In this instance, two, three, four, . . . , etc. ultrasonic nips may be formed consecutively in the machine direction. Such an embodiment comprising two series is illustrated in FIG. 1C showing two ultrasonic nips, each formed between the ultrasonic applicator 90 and the anvil 91, and two pairs of the pressing nips, each formed between the impressing roll 95 and the support roll 96. In FIG. 1C, the pressing nips immediately follow the ultrasonic nips. The serial application of the ultrasonic energy may offer a higher flexibility in regard to a design of the process, as well as better control over the resulting level of the ultrasonic energy coupled to the web 10 due to an ability to provide for a greater resulting residence time.

Figure 2:
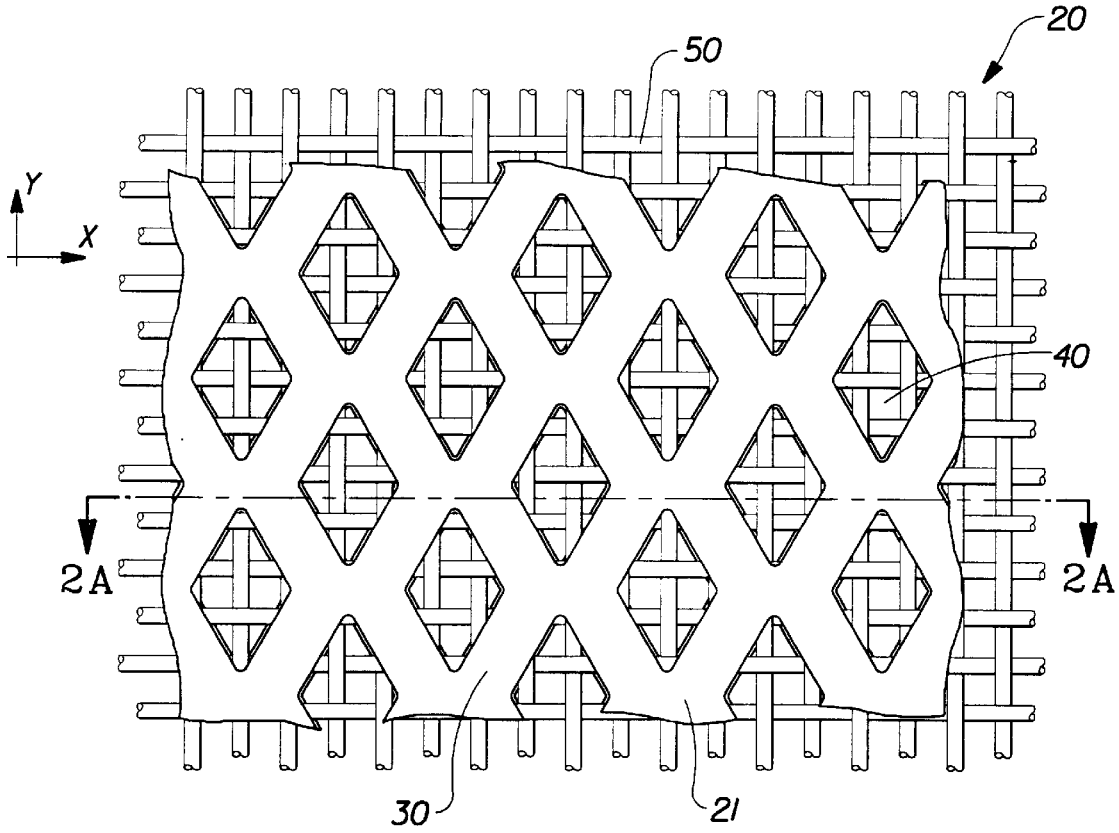
FIG. 2 is a schematic top plan view of a papermaking belt utilized in the process of the present invention, having an essentially continuous web-side network and discrete deflection conduits.
Figure 2A:
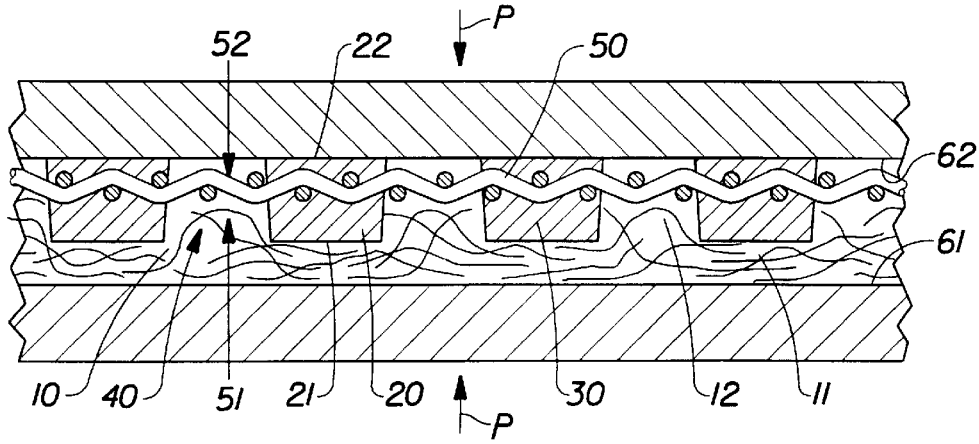
FIG. 2A is a schematic fragmentary cross-sectional view of the papermaking belt taken along lines 2A—2A of FIG. 2, and showing a cellulosic web in association with the papermaking belt being pressurized between a first press member and a second press member.
Figure 3:
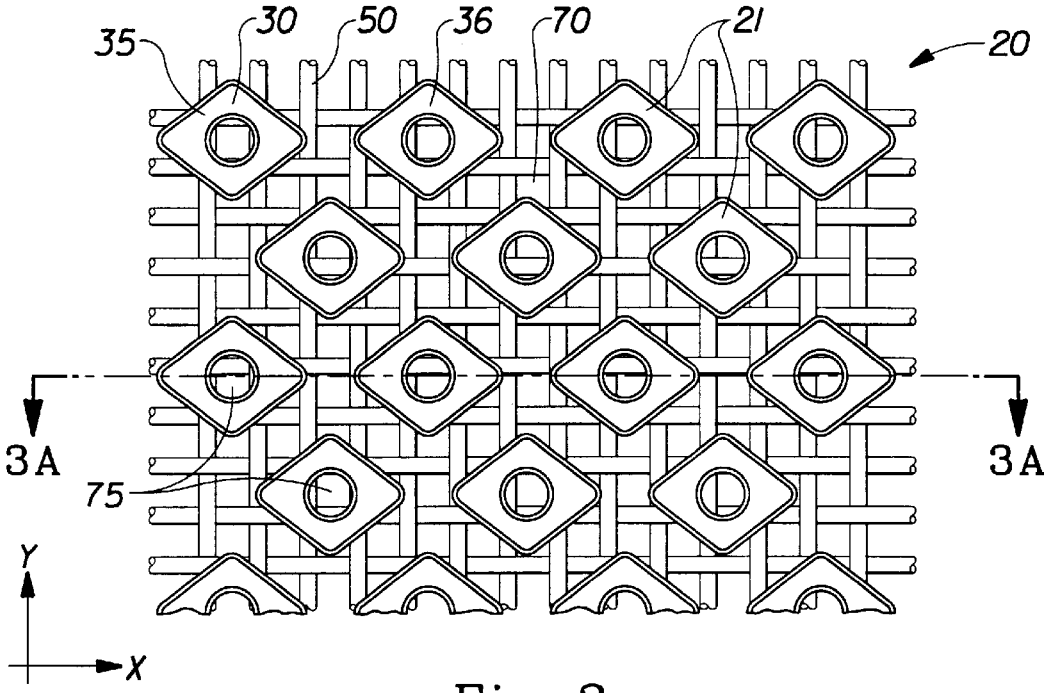
FIG. 3 is a schematic top plan view of the papermaking belt comprising a framework formed by discrete protuberances encompassed by an essentially continuous area of deflection conduits, the discrete protuberances having a plurality of discrete deflection conduits therein.
Figure 3A:
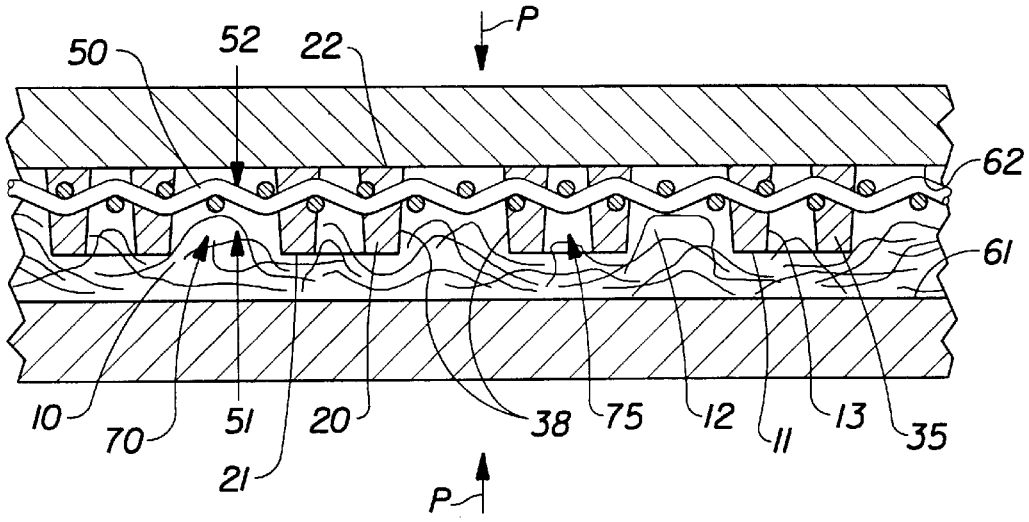
FIG. 3A is a schematic fragmentary cross-sectional view of the papermaking belt taken along lines 3A—3A of FIG. 3 and showing a cellulosic web in association with the papermaking belt being pressurized between a first press member and a second press member.
Figure 4:
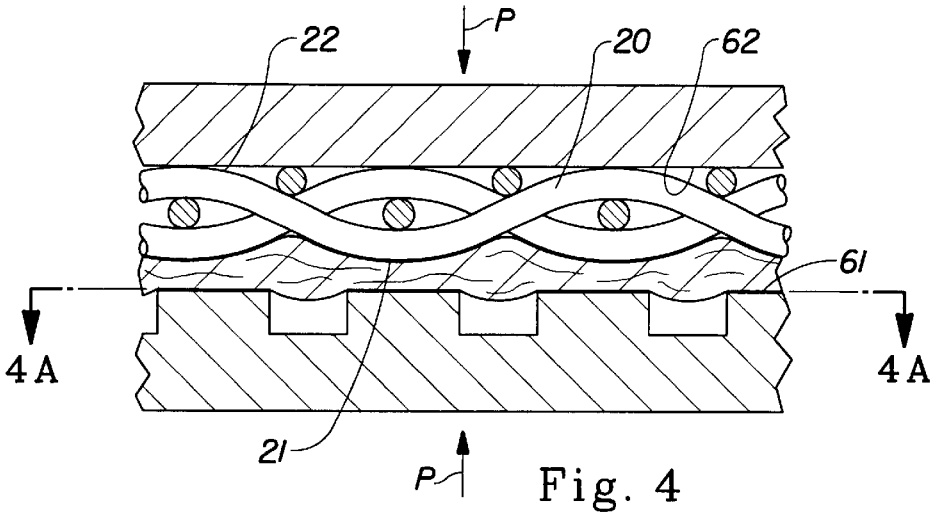
FIG. 4 is a schematic fragmentary cross-sectional view similar to that shown in FIG. 3A, and showing an embodiment of the first press surface.
Figure 4B:
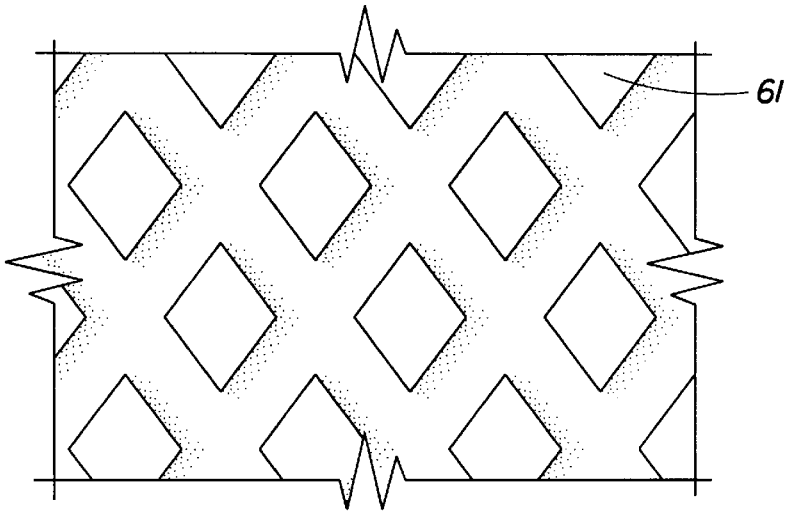
FIG. 4B is a view similar to that shown in FIG. 4A, and showing an embodiment of the first press surface comprising a macroscopically-planar plurality of protrusions extending therefrom.
Figure 4A:
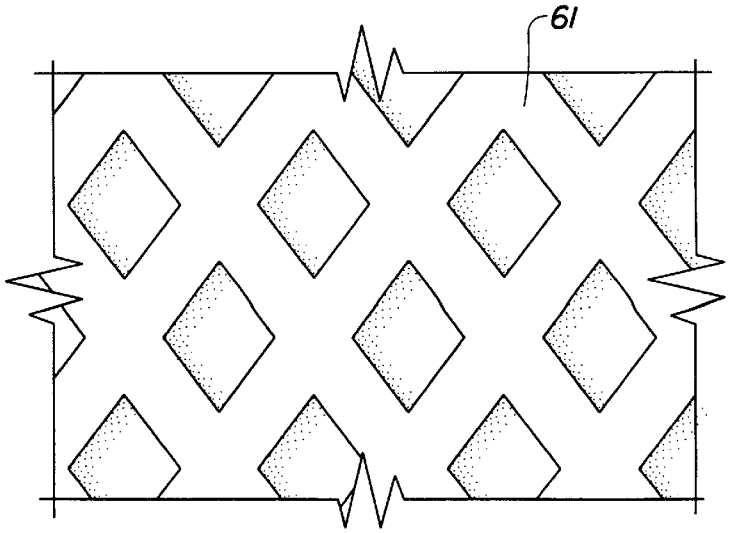
FIG. 4A is a schematic fragmentary plan view, taken along lines 4A—4A of FIG. 4, of the first press surface comprising a macroscopically-planar and continuously-reticulated network.

The next step is applying pressure to the selected portions 11 of the web 10. The step of applying pressure is preferably accomplished by subjecting the web 10 and the belt 20 to a pressure between two mutually opposite press surfaces: a first press surface 61 and a second press surface 62, as best shown in FIGS. 2A, 3A, and 4. The web 10 and the belt 20 are interposed between the first press surface 61 and the second press surface 62 such that the first press surface 61 contacts the web 10, and the second press surface 62 contacts the backside surface 22 of the belt 20. Preferably, the first press surface 61 contacts selected portions 11 of the web 10.

The first press surface 61 and the second press surface 62 are pressed toward each other. In FIGS. 2A, 3A, and 4, the direction of the pressure is schematically indicated by the directional arrows P. Preferably, the first press surface 61 impresses the selected portions 11 against the web-facing surface 21 of the belt 20, thereby causing the fibers 100 which are mutually juxtaposed in the selected portions 11 to conform to each other under the pressure P. As a result of the application of the pressure P, a resulting area of contact between the fibers 100 in the selected portions 11 increases, and the softened fluid-latent indigenous polymers becomes flowable and interconnects the adjacent and mutually juxtaposed fibers 100 in the selected portions 11.

One skilled in the art will understand that, as used herein, the terms "fluidization," "softening," and "flowing," and their derivatives are relative terms describing a relative condition of the fluid-latent indigenous polymers at a certain point of the process. As a result of "fluidization," the fluid-latent indigenous polymers become "soft"; the pressure further causes the fluid-latent indigenous polymers to "flow" and interconnect those fibers 100 which are juxtaposed under the pressure in the web 10. Depending on a particular embodiment of the process of the present invention, the change in the condition of the fluid-latent indigenous polymers may, but need not, occur consecutively—from "fluidization" through "softening" and to "flowing."

In FIG. 1, the ultrasonic energy is applied, preferably under pressure, to the web 10 by the ultrasonic applicator 90 before the web 10 is impressed between pressing surfaces 61 and 62, and before, or in the very beginning of, heating the web 10. In this embodiment of the process, the ultrasonic energy initiates fluidization of the fluid-latent indigenous polymers by shear thinning and rapid heating due to internal absorption, and thereby creates conditions for reducing the residence time for the consequently applied temperature and pressure. Alternatively or additionally, such an ultrasonic pre-treatment of the web 10 allows to reduce the temperature and/or pressure necessary to cause the fluid-latent indigenous polymers to flow in the web 10, thereby interconnecting the fibers 100.

FIG. 1A shows another embodiment of the process of the present invention, in which—first, the web 10 is heated in the zone D by the heating band 80, as described above, to begin fluidization of the fluid-latent indigenous polymers. Second, the ultrasonic energy is applied to the web 10 in the ultrasonic nip formed between the ultrasonic applicator 90 and the anvil 91 to intensify fluidization of the web 10. And finally, the web 10 is impressed between the first and second press members 61 and 62, respectively, while the web 10 is further heated by the other heating band 80 in the zone E.

In FIG. 1B, the web 10 and the belt 20 are impressed between the surface of the Yankee drum 14 and at least one pressing roll 60. The surface of the Yankee drum 14 comprises the first press surface 61, contacting the web 10, and preferably the web's selected portions 11. The surface of pressing rolls 60 comprises the second press surface 62, contacting the backside surface 21 of the belt 20. In FIG. 1B, the second press surface 62 comprises the surfaces of two consecutive pressing rolls 60: the pressing roll 60*a* and the pressing roll 60*b*, each pressing roll applying pressure to the backside surface 21 of the belt 20: the pressing roll 60*a* applying pressure P1, and the pressing roll 60*b* applying pressure P2. The use of a plurality of the pressing rolls 60 allows to have application of the pressure in discrete stages, for example, the pressure P2 may be greater than the pressure P1, or vice versa. Preferably, the pressure at each of the pressing rolls 60*a* and 60*b* is applied perpendicularly to the surface of the Yankee drying drum 14, i.e., towards the center of rotation of the Yankee drying drum 14. Each of the pressing rolls 60 is preferably a resilient roll elastically deformable under the pressure applied towards the surface of the Yankee drying drum 14.

In FIG. 1B, the ultrasonic means is located before (when viewed in MD) the first pressing roll 60*a*. Thus, the fluidization of the fluid-latent indigenous polymers begins before the web 10 is subjected to the pressure P1. However, analogously to the embodiment shown in FIG. 1A, the ultrasonic nip be located after the first pressing roll 60*a* and before the second pressing roll 60*b* (not shown).

FIG. 1C shows another preferred embodiment of the process and the apparatus of the present invention. In FIG. 1C, after the ultrasonic energy has been coupled to the web 10, the web 10 is subjected to a relatively high pressure between a pair of rolls: a web-contacting roll 95 and a belt-contacting roll 96. The web-contacting roll 95 can have a patterned surface 95*a*. In FIG. 1C the preferred pressure is from about 100 pounds per square inch (psi) to 10000 psi, and the more preferred pressure is from about 500 psi to about 5000 psi.

It is believed that the most advantageous utilization of the ultrasonic energy occurs when the ultrasonic energy is applied in combination with the heating of the web. Then, the ultrasonic energy and the heating act in concert, complementing each other, to fluidize the fluid-latent indigenous polymers contained in the web. It does not exclude, however, fluidization of the fluid-latent indigenous polymers by the ultrasonic energy alone and without heating. One skilled in the art will appreciate that the ultrasonic energy coupled to the web 10 is absorbed by the web 10 and thereby is converted to heat. An addition, the ultrasonic energy reduces the viscosity of the fluid-latent indigenous polymers by shear thinning.

Preferably, therefore, the process of the present invention comprises the step of heating the web 10, or at least its selected portions. As used herein, the term "heating" of the web 10 designates heating not caused by the application of ultrasonic energy, i.e., conductive, convective, or radiating heating by a source other than ultrasonic vibration.

Preferably, the heating comprises raising the temperature of the web 10 by contacting the web 10 by a hot medium (such, for example, as hot surface, hot air, hot steam, etc.). The step of heating the web 10 can be accomplished by a variety of means known in the art. For example, the web 10 may be heated by a hot heating band 80, as schematically shown in FIG. 1. The heating band 80 travels around return rolls 85*a*, 85*b*, 85*c*, and 85*d* in the direction indicated by the directional arrow C. The heating band 80 is in contact with the web 10. The heating band 80 is heated by a heating apparatus 85. Such principal arrangement is disclosed in U.S. Pat. No. 5,594,997 issued to Jukka Lehtinen on Jan. 21, 1997 and assigned to Valmet Corporation (of Finland). Alternatively or additionally, the web 10 can be heated by steam, as disclosed in U.S. Pat. No. 5,506,456 issued to Jukka Lehtinen on Mar. 26, 1985 and assigned to Valmet Corporation (of Finland). Both foregoing patents are incorporated by reference herein.

In the preferred embodiment of the process of the present invention, the temperature, the ultrasonic energy, and the pressure work in concert to fluidize the fluid-latent indigenous polymers. The ultrasonic energy may be applied through the pressing means (not shown), i.e., through the pressing member 61 in FIG. 1, or through the pressing rolls 60 in FIG. 1B. In such an embodiment, the ultrasonic energy may be applied to the web 10 simultaneously with the application of convective heating and pressure.

As has been pointed out above, when the web 10 is transferred to the Yankee drying drum 14 under the traditional paper-making conditions, the residence time during which the web 10 is under pressure between the surface of the Yankee drum 14 and the impressing nip roll 29*e* (FIG. 1) is too short to effectively cause the fluid-latent indigenous polymers to soften and flow. Although some densification does occur during the transfer at the nip between the surface of the Yankee drum 14 and the surface of the impression nip roll 29*e*, the traditional papermaking conditions do not allow to maintain the web 10 under pressure for more than about 2–5 milliseconds. This period of time is too short to cause the fluid-latent indigenous polymers to flow; it is believed that for the purposes of causing the softened fluid-latent indigenous polymers to flow and interconnect the fibers in the selected portions 11, the preferred residence time should be at least about 0.1 second (100 milliseconds). The process of the present invention will allow to significantly reduce the residence time.

The next step of the process involves immobilization of the flowing fluid-latent indigenous polymers and creating fiber-bonds between the cellulosic fibers 100 which are interconnected in the selected portions 11 of the web 10. The step of immobilization of the fluid-latent indigenous polymers may be accomplished by either cooling of the first portion 11 of the web 10, or drying of the first portion 11 of the web 10, or releasing the pressure to which the first portion 11 of the web 10 has been subjected. The three foregoing steps may be performed either in the alternative, or in combination, concurrently or consecutively. For example, in one embodiment of the process, the step of drying alone, or alternatively the step of cooling alone, may be sufficient to immobilize the fluid-latent indigenous polymers. In another embodiment, for example, the step of cooling may be combined with the step of releasing the pressure. Of course, all three steps may be combined to be performed concurrently, or consecutively in any order. If desired, the resulting web could be creped from the apparatus. A creping blade could be made according to commonly assigned U.S. Pat. No. 4,919,756, issued to Sawdai, which patent is incorporated herein by reference.

One method of determining if the fiber-bonds of fluid-latent indigenous polymers have been formed is described in an article by Leena Kunnas, et al., "*The Effect of Condebelt Drying on the Structure of Fiber Bonds,*" *TAPPI Journal*, Vol. 76, No. 4, April 1993, which article is incorporated by reference herein and attached hereto as an Appendix.

What is claimed is:

1. A process for making a differential density cellulosic web comprising a first plurality of high-density micro-regions and a second plurality of low-density micro-regions, said process comprising the steps of:

(a) providing a fibrous web comprising fluid-latent indigenous polymers and water;

(b) providing a macroscopically monoplanar molding fabric having a web-side surface and a backside surface opposite to said web-side surface;

(c) depositing said fibrous web on said web-side surface of said molding fabric;

(d) applying ultrasonic energy to at least selected portions of said fibrous web thereby contributing to softening of said fluid-latent indigenous polymers in said selected portions;

(e) impressing said web-side surface of said molding fabric into said fibrous web under pressure, thereby densifying said selected portions of said web and causing said fluid-latent indigenous polymers to flow and interconnect said cellulosic fibers which are mutually juxtaposed in said selected portions; and (f) immobilizing said flowable fluid-latent indigenous polymers and creating bonds of said fluid-latent indigenous polymers between said cellulosic fibers which are interconnected in at least said selected portions of said fibrous web, thereby forming said first plurality of high-density micro-regions from said selected portions.

2. The process according to claim 1, further comprising a step of heating at least said selected portions of said fibrous web.

3. The process according to claim 2, wherein said step of applying ultrasonic energy and said step of heating are coupled and work in cooperation to cause softening of said fluid-latent indigenous polymers in said at least selected portions of said fibrous web.

4. The process according to claim 3, wherein said step of applying ultrasonic energy precedes said step of heating.

5. The process according to claim 3, wherein said step of applying ultrasonic energy and said step of heating are performed concurrently.

6. The process according to claim 2, wherein said step of immobilizing said flowable fluid-latent indigenous polymers and creating said bonds of said immobilized fluid-latent indigenous polymers comprises drying at least said selected portions of said web.

7. The process according to claim 2, wherein said step of immobilizing said flowable fluid-latent indigenous polymers and creating said bonds of said immobilized fluid-latent indigenous polymers comprises cooling at least said selected portions of said web under said pressure.

8. The process according to claim 2, wherein said step of immobilizing said flowable fluid-latent indigenous polymers and creating said bonds of said immobilized fluid-latent indigenous polymers comprises releasing at least said selected portions of said fibrous web from said pressure.

9. The process according to claim 2, wherein said step of immobilizing said flowable fluid-latent indigenous polymers and creating said bonds of said immobilized fluid-latent indigenous polymers comprises drying said web to a consistency of at least about 70% at a temperature less than about 70° C.

10. The process according to claim 9, further comprising the step of applying a fluid pressure differential to said web of said cellulosic fibers such as to leave said first portion of said web on said web-side surface of said papermaking belt while deflecting said second portion of said web into said deflection conduits, thereby removing a portion of said liquid carrier from said web, said step of applying a fluid pressure differential to said web being performed subsequently to said step (c).

11. The process according to claim 1, wherein said ultrasonic energy has frequency from about 16,000 Hz to about 100,000 Hz.

12. The process according to claim 11, wherein said ultrasonic energy has frequency from about 20,000 Hz to about 80,000 Hz.

13. The process according to claim 11, wherein said ultrasonic energy is applied to a web in the amount of from 1 Watt per square centimeter to 100 Watt per square centimeter.

14. The process according to claim 13, wherein said ultrasonic energy is applied to a web in the amount of from 5 Watt per square centimeter to 50 Watt per square centimeter.

15. The process according to claim 13, wherein a residence time during which said ultrasonic energy is applied to a portion of said web is from about 1 millisecond to about 100 milliseconds.

16. The process according to claim 15, wherein said residence time is from about 1 millisecond to about 10 milliseconds.

17. The process according to claim 1, wherein in said step (b), said molding fabric comprises an endless papermaking belt.

18. The process according to claim 17, wherein said papermaking belt has deflection conduits extending between said web-side surface and said backside surface.

19. The process according to claim 1, wherein said papermaking belt comprises a resinous framework joined to a fluid-permeable reinforcing structure, said resinous framework having a first side and a second side opposite said first side, said first and second sides defining said web-side and backside surfaces of said papermaking belt, respectively, said reinforcing structure being positioned between said web-side and backside surfaces.

20. The process according to claim 19, wherein, said web-side surface of said papermaking belt comprises an essentially continuous web-side network, said web-side network defining web-side openings of said deflection conduits, and said backside surface of said papermaking belt comprises a backside network, said backside network defining backside openings of said deflection conduits.

21. The process according to claim 1, wherein said step (e) of impressing said web-side surface of said molding fabric into said web comprises impressing said web and said molding fabric between a first press surface contacting said web and a second press surface contacting said molding fabric.

22. The process according to claim 21, wherein said first press surface comprises an endless pressing belt.

23. The process according to claim 21, wherein said first press surface comprises a surface of a Yankee drying drum.

24. The process according to claim 1, wherein said fluid-latent indigenous polymers comprise hemicelluloses.

25. The process according to claim 1 or 24, wherein said fluid-latent indigenous polymers comprise lignin.

26. A process for making a differential density cellulosic web comprising a first plurality of high density micro-regions and a second plurality of low density micro-regions, said process comprising the steps of:

(a) providing a plurality of papermaking cellulosic fibers comprising fluid-latent indigenous polymers;

(b) providing a forming belt;

(c) depositing said plurality of cellulosic fibers comprising fluid-latent indigenous polymers on said forming belt and forming a web of said cellulosic fibers on said forming belt;

(d) providing a macroscopically monoplanar papermaking belt having a web-side surface, a backside surface opposite to said web-side surface, and deflection conduits extending between said web-side surface and said backside surface;

(e) transferring said web of said cellulosic fibers to said web-side surface of said papermaking belt, said web comprising a first portion corresponding to said web-side surface, and a second portion corresponding to said deflection conduits;

(f) applying ultrasonic energy to at least said first portion of said web thereby causing said fluid-latent indigenous polymers to soften in said first portion;

(g) impressing said web-side surface of said papermaking belt into said web under pressure, thereby densifying said first portion of said web and causing said fluid-latent indigenous polymers to flow and interconnect said cellulosic fibers which are mutually juxtaposed in said first portion; and (h) immobilizing said flowable fluid-latent indigenous polymers thereby creating bonds of said fluid-latent indigenous polymers between said cellulosic fibers which are interconnected in said first portion.

27. A process for making a cellulosic web, said process comprising the steps of:

(a) providing a fibrous web comprising fluid-latent indigenous polymers and water;

(b) providing a macroscopically monoplanar and fluid-permeable papermaking belt having a web-side surface defining an X-Y plane, a backside surface opposite said web-side surface, and a Z-direction perpendicular to said X-Y plane;

(c) depositing said fibrous web on said web-side surface of said papermaking belt;

(d) applying ultrasonic energy to said fibrous web thereby causing softening of said fluid-latent indigenous polymers in said web;

(e) impressing said web-side surface of said papermaking belt into said fibrous web under pressure, thereby densifying said web and causing said fluid-latent indigenous polymers to flow and interconnect said cellulosic fibers which are mutually juxtaposed in said web under said pressure; and (f) immobilizing said flowable fluid-latent indigenous polymers thereby creating bonds of said fluid-latent indigenous polymers between said cellulosic fibers which are interconnected in said web.

* * * * *